US008960281B2

(12) United States Patent
Epperson et al.

(10) Patent No.: US 8,960,281 B2
(45) Date of Patent: Feb. 24, 2015

(54) FLOWBORE MOUNTED SENSOR PACKAGE

(75) Inventors: Brandon Charles Epperson, Pearland, TX (US); Gregory Christopher Grosz, Montgomery, TX (US); Alison Paige McVea, Houston, TX (US)

(73) Assignee: National Oilwell DHT, L.P., Houston, TX (US)

( * ) Notice: Subject to any disclaimer, the term of this patent is extended or adjusted under 35 U.S.C. 154(b) by 188 days.

(21) Appl. No.: 13/177,918

(22) Filed: Jul. 7, 2011

(65) Prior Publication Data

US 2013/0008640 A1 Jan. 10, 2013

(51) Int. Cl.
*E21B 47/01* (2012.01)
*E21B 23/01* (2006.01)

(52) U.S. Cl.
CPC ..... *E21B 47/01* (2013.01); *E21B 23/01* (2013.01)
USPC ..... 166/250.11; 166/66; 175/339; 175/40

(58) Field of Classification Search
CPC ..... E21B 47/01
USPC ..... 166/250.11, 217; 175/325.6, 339; 73/152.01, 152.43–49
See application file for complete search history.

(56) References Cited

U.S. PATENT DOCUMENTS

| | | | | |
|---|---|---|---|---|
| 3,180,419 | A * | 4/1965 | Cochran et al. | 166/120 |
| 3,493,046 | A * | 2/1970 | Biggs et al. | 166/217 |
| 4,149,593 | A | 4/1979 | Gazda et al. | |
| 5,348,091 | A | 9/1994 | Tchakarov et al. | |
| 5,353,872 | A | 10/1994 | Wittrisch | |
| 5,813,480 | A | 9/1998 | Zaleski, Jr. et al. | |
| 6,851,491 | B2 | 2/2005 | Marshall | |
| 7,350,565 | B2 | 4/2008 | Hall et al. | |
| 7,468,679 | B2 * | 12/2008 | Feluch | 340/855.4 |
| 7,604,072 | B2 | 10/2009 | Pastusek et al. | |
| 2001/0054514 | A1 * | 12/2001 | Sullivan et al. | 175/40 |
| 2006/0102361 | A1 * | 5/2006 | Fay et al. | 166/387 |
| 2007/0221408 | A1 * | 9/2007 | Hall et al. | 175/57 |

OTHER PUBLICATIONS

PCT/US2012/042656 International Search Report and Written Opinion dated Aug. 6, 2013 (10 p.).

* cited by examiner

*Primary Examiner* — Jennifer H Gay
*Assistant Examiner* — George Gray
(74) *Attorney, Agent, or Firm* — Conley Rose, P.C.

(57) ABSTRACT

Apparatus including a sensor-containing body is disposable within a flowbore of a downhole tool. The apparatus also comprises an adjustable engagement mechanism that is coupled to the body. The engagement mechanism has a first position that allows the body to move longitudinally through the flowbore, and a second position that prevents movement of the body relative to the flowbore.

19 Claims, 3 Drawing Sheets

FLOWBORE MOUNTED SENSOR PACKAGE

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND

This disclosure relates generally to apparatus and methods for securing a sensor package within a tubular member. The oil and gas industry has seen a significant increase in systems and methods for acquiring and analyzing data gathered during drilling or other wellbore operations. Data acquired during wellbore operations can prove critical in evaluating drilling techniques, predicting system behavior, and designing improved wellbore tools. For example, being able to analyze data representing the actual forces and accelerations imparted on a particular tool during drilling operations may allow for modifications of the drilling process or improvements to tools that prolong tool life and reduce the cost of drilling.

In order to best understand what is happening in the wellbore, it is often desirable to be able to place data sensors and acquisition systems in the wellbore as close as possible to the tools being analyzed. One method used to place data sensors and acquisition systems in a wellbore is using a sub-assembly ("sub") that is incorporated into the drill string and uses a short tubular member to house the data sensors and acquisition systems. Because the sub is incorporated into the drill string, in many applications it cannot be located at the most desirable location for data acquisition. In response to this limitation, efforts have been made to incorporate sensors and data acquisition equipment directly into drill string tools, such as drill bits.

Although incorporating sensors and data acquisition systems directly into a drill string tool places the data acquisition equipment in a more desirable location, it often means utilizing a modified or specially designed drill string tool. Due to the wide variety of drill string tools available to operators, having another set of unique tools may be less than desirable.

Other factors that must be considered in utilizing data sensors and acquisition systems in a wellbore include the harsh conditions of the wellbore environment and the extreme forces created during the drilling process. Any data sensor or acquisition system deployed in a wellbore must be able to withstand extreme pressures, temperatures, and dynamic forces for extended periods of time. Therefore, wellbore-deployed data sensors and acquisition systems must be robustly designed so as to withstand this extreme environment. This is especially critical when attempting to acquire data on downhole forces and accelerations, as any movement of the data sensor or acquisition system relative to the drill string can result in erroneous and unusable data.

There is a continuing need in the art for systems that allow data sensors and acquisition systems to be used in a wellbore environment during drilling or other operations.

BRIEF SUMMARY OF THE DISCLOSURE

This disclosure describes an apparatus that comprises a sensor-containing body, which is disposable within a flowbore of the downhole tool. The apparatus also comprises an adjustable engagement mechanism that is coupled to the body. The engagement mechanism has a first position that allows the body to be moved longitudinally through the flowbore and a second position that prevents movement of the body relative to the flowbore.

This disclosure also describes a sensor package for use in a downhole tool. The sensor package comprises a body configured to be disposed within a flowbore of a downhole tool and a sensor assembly disposed within the body. A plurality of inclined ramps is disposed on the body and each of the inclined ramps has a contact fin slidably coupled thereto. The contact fins have a first position that allows movement of the body relative to the flowbore and a second position that prevents movement of the body relative to the flowbore.

This disclosure also describes a method for installing a sensor package in a downhole tool. A sensor package is installed by slidably engaging a contact fin with an inclined ramp disposed on a body that houses a sensor assembly. The sensor package is positioned within a flowbore of the downhole tool, and the contact fin is moved along the inclined ramp until the contact fin engages a wall of the flowbore.

BRIEF DESCRIPTION OF THE DRAWINGS

For a more detailed description of the embodiments of the present disclosure, reference will now be made to the accompanying drawings, wherein.

DETAILED DESCRIPTION OF DISCLOSED EMBODIMENTS

Figure 1:
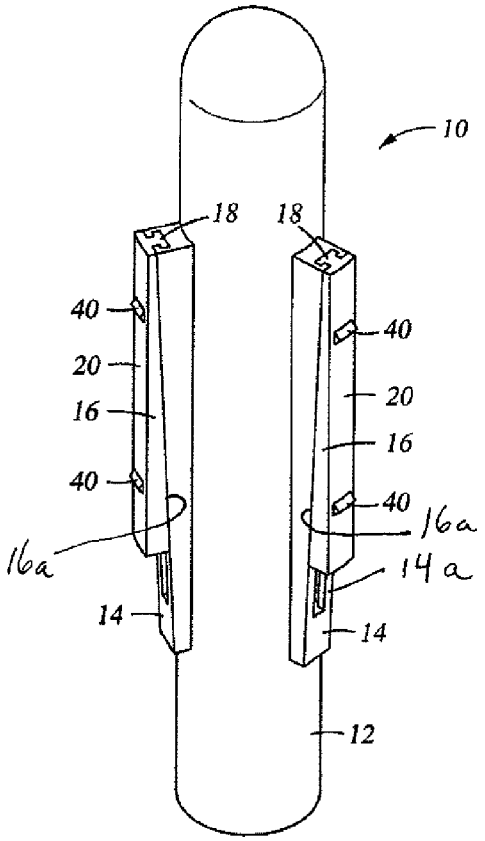
FIG. 1 is an isometric view of a sensor package.

In the drawings and description that follow, like parts are typically marked throughout the specification and drawings with the same reference numerals. The drawing figures are not necessarily to scale. Certain features of the invention may be shown exaggerated in scale or in somewhat schematic form, and some details of conventional elements may not be shown in the interest of clarity and conciseness. The present disclosure is susceptible to embodiments of different forms. Specific embodiments are described in detail and are shown in the drawings, with the understanding that the present disclosure is to be considered an exemplification of the principles of the invention, and is not intended to limit the invention to those exemplary embodiments illustrated and described herein. It is to be fully recognized that the different features and characteristics of the embodiments discussed below may be employed separately or in any suitable combination to produce desired results.

Unless otherwise specified, any use of any form of the terms "connect", "engage", "couple", "attach", or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". The various characteristics mentioned above, as well as other features and characteristics described in more detail below, will be readily apparent to those skilled in the art upon reading the following detailed description of the embodiments, and by referring to the accompanying drawings.

Figure 2:
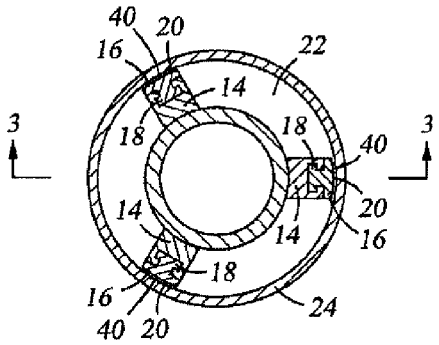
FIG. 2 is a partial-sectional plan view of a sensor package installed in a tubular member.
Figure 3:
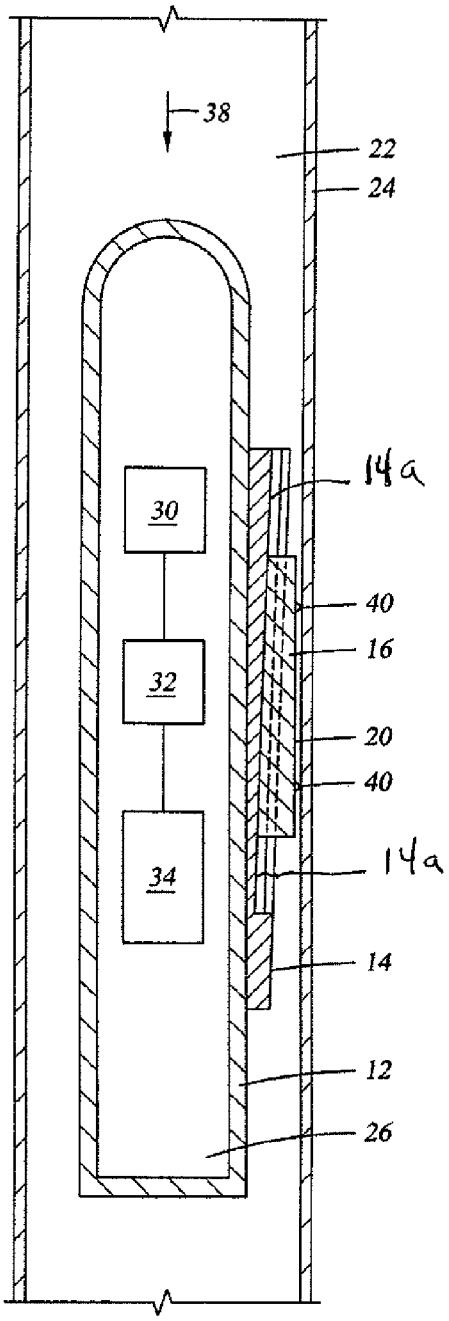
FIG. 3 is a partial-sectional schematic view of the sensor package of FIG. 2.

Referring initially to FIGS. 1-3, sensor package 10 comprises body 12 and contact fins 16. Body 12 is shown as an elongated cylindrical body having a plurality of inclined ramps 14 protruding radially outward and extending in a direction substantially parallel with the longitudinal axis of the body. Contact fins 16 and inclined ramps 14 form an engagement mechanism that enables sensor package 10 to be secured within the flowbore of a downhole tool, such as a drill bit. Contact fins 16 and inclined ramps 14 may be spaced around the circumference of sensor package 10 so as to place the sensor package in a position substantially aligned with the central axis of the tool's flowbore.

FIGS. 2 and 3 illustrate sensor package 10 installed in the flowbore 22 of a downhole tool 24. Although flowbore 22 is illustrated as having a circular cross-section, it is understood that sensor packages having engagement mechanisms similar to those described herein may be installed in flowbores having other shapes and configurations. FIG. 2 shows a partial-sectional end view of sensor package 10 installed in the flowbore 22 of downhole tool 24. FIG. 3 is a partial sectional view of sensor package 10 taken along section 3-3 of FIG. 2.

Contact fins 16 have one side that is slidably coupled to an inclined ramp 14 by engagement with slot 18 and have an opposite side having an outer engagement surface 20. Contact fins 16 and inclined ramps 14 have facing, inclined surfaces that slidingly engage one another and serve to adjust the radial position of engagement surfaces 20 as the fins move longitudinally along the ramps. The cooperating inclined facing surfaces are preferably configured such that engagement surfaces 20 remain substantially parallel with the longitudinal axis of body 12 as the contact fins 16 move along inclined ramps 14 so as to maintain reliable engagement with the wall of flowbore 22. As can be seen in reference to FIG. 3, sensor package 10 is installed in flowbore 22 so that flow 38 tends to push the sensor package in a direction that forces contact fins 16 radially outward and into engagement with the wall of the flowbore due to the camming action between the inclined surfaces 16*a*, 14*a*. Engagement surfaces 20, in this embodiment, are radiused to generally conform to the radius of the inner surface of the flowbore 22. However, engagement surfaces 20 may be substantially planar or may have other shapes. Contact fins 16 may further comprise teeth 40 that further enhance the engagement with the wall of flowbore 22.

In addition to inclined ramps 14, body 12 comprises sensor chamber 26, which houses a sensor assembly comprising sensor 30, memory 32, and battery 34. Sensor 30 may be configured to measure rate of rotation, acceleration, magnetic forces, temperature, or any other desired data. Memory 32 is configured to store that data until the assembly is retrieved to the surface. As previously discussed, in order to ensure collection of reliable and usable data, sensor package 10 must remain securely fixed relative to flowbore 22. Even small changes in the position of sensor package 10 relative to flowbore 22 may result in erroneous data being recorded.

Figure 4:
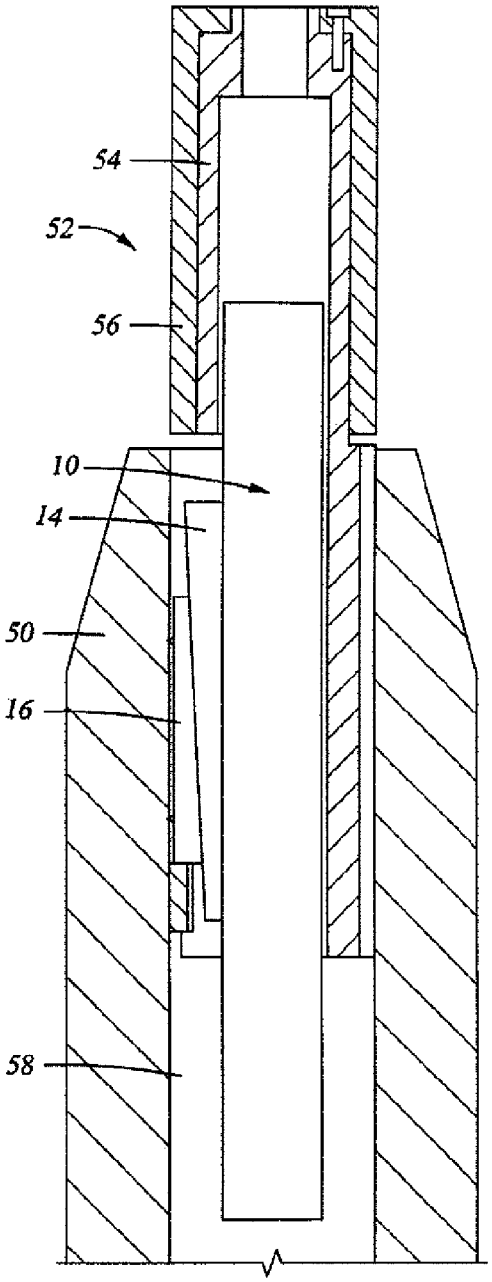
FIG. 4 is a partial-sectional view of the installation of a sensor package into a tubular member.

Referring now to FIG. 4, sensor package 10 is shown being installed into the pin connection of downhole tool 50 by utilizing installation tool 52. Installation tool 52 comprises housing 54 and fin retainer 56. Sensor package 10 is coupled to installation tool 52 and the installation tool is inserted into the flowbore of downhole tool 50. Once placed at the desired axial (i.e., longitudinal) location in downhole tool 50, fin retainer 56 is moved upward. The upward movement of fin retainer 56 causes contact fins 16 to move upward relative to inclined ramps 14. As contact fins 16 move upward relative to inclined ramps 14, the contact fins are cammed radially outward and into engagement with the wall of downhole tool 50. Contact fins 16 are moved outward substantially in unison, so as to ensure proper engagement and concentricity with the flowbore of downhole tool 50. Once contact fins 16 engage the inner wall of downhole tool 50, the continued movement of contact fins 16 creates an interference fit of sensor package 10 in the downhole tool that prevents the movement of the sensor package relative to the downhole tool.

As discussed in reference to FIG. 3, sensor package 10 is installed in flowbore 58 of downhole tool 50 so that the flow through the flowbore creates a downward force on the sensor package. This downward force acts to create additional contact force between contact fins 16 and the wall of flowbore 58. In order to remove sensor package 10 from flowbore 58, the sensor package can be pulled upward allowing contact fins 16 to retract and disengage the wall of flowbore 58.

Figure 5:
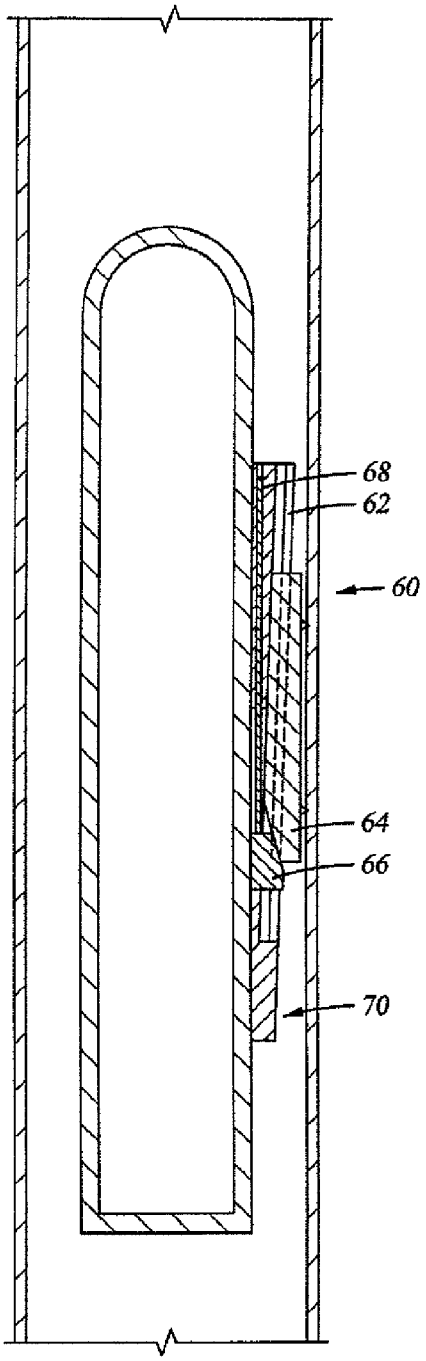
FIG. 5 is a partial-sectional view of a sensor package having a secondary lock.

Referring now to FIG. 5, an alternative engagement mechanism 60 is shown that provides a secondary lock to assist in locking the sensor package in place. The secondary lock may be desirable in certain conditions where the sensor package may be subjected to loads that could cause the previously described engagement mechanism to disengage. In certain embodiments, a secondary lock may be utilized on one or more engagement mechanisms on a particular sensor package.

Alternative engagement mechanism 60 comprises inclined ramp 62, contact fin 64, and locking wedge 66. Similar to those described above with reference to FIG. 3, contact fin 64 is slidably coupled to inclined ramp 62. Locking wedge 66 is coupled to adjustment rod 68 that is operable to move the locking wedge longitudinally relative to inclined ramp 62. Once contact fin 64 is fully engaged with the wall of flowbore 70, locking wedge 66 is moved into contact with the contact fin using adjustment rod 68. Adjustment rod 68 may be threadably engaged with inclined ramp 62 so that rotation of the adjustment rod moves locking wedge 66. Once locking wedge 66 is moved into contact with contact fin 64, the contact fin can no longer move down inclined ramp 62 and the sensor package is positively locked into position.

Figure 7:
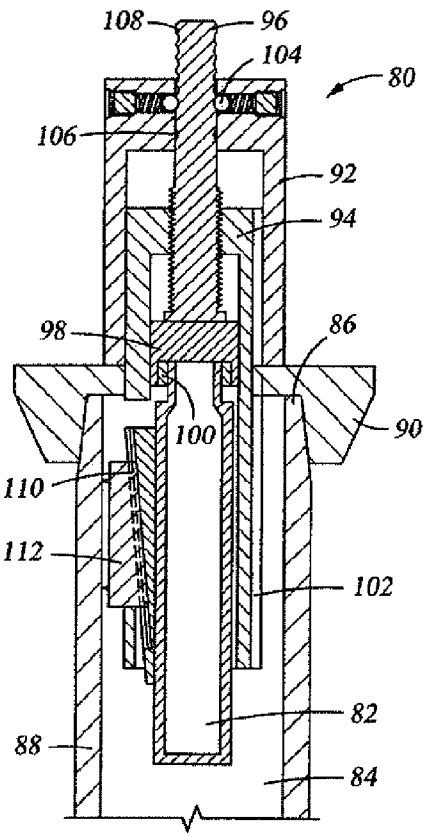
FIG. 7 is a sectional view of a second step in the installation of the sensor package of FIG. 6.
Figure 6:
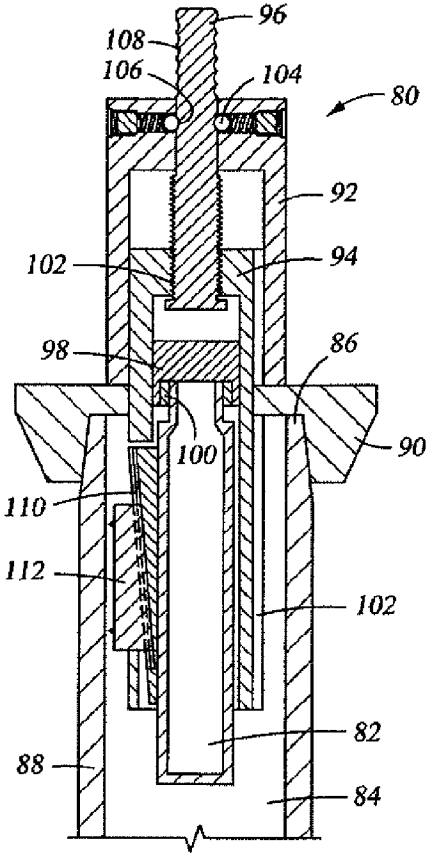
FIG. 6 is a sectional view of a first step in the installation of a sensor package into a tubular member.

Referring now to FIGS. 6 and 7, a two-step installation tool 80 is shown. In operation, two-step installation tool 80 allows for a sensor package 82 to be installed in flowbore 84 at a fixed axial location relative to pin end 86 of downhole tool 88. Being able to consistently install sensor package 82 at a fixed location within flowbore 84 may be desirable in certain applications so as to improve data acquisition or so as not to constrict fluid movement through the flowbore. It is also desirable to have an installation tool that operates without the need for special training or the requirements for precise measurements during installation.

Installation tool 80 comprises base member 90, upper housing 92, fin retainer 94, actuation rod 96, and body ring 98. Base member 90 is placed on pin end 86 and may be temporarily coupled to the pin end via setscrews or other suitable means. Sensor package 82 is inserted into body ring 98, which includes gripping member 100 that engages the end of the sensor package. Fin retainer 94 is disposed around sensor package 82 and body ring 98. Fin retainer 94 is inserted through base member 90 into flowbore 84. Keyway 102 in fin retainer 94 allows longitudinal movement of the fin retainer but limits rotational movement of the fin retainer relative to base member 90 and upper housing 92. Actuation rod 96 is threadably coupled to fin retainer 94 via threads 102. Actuation rod 96 projects out of the top of upper housing 92. Actuation rod 96 is rotatably coupled to the upper housing by balls 104 that are engaged with race 106. Actuation rod 96 also has a ball thread 108 that engages balls 104 once they disengage from race 106.

Once installation tool 80 and sensor package 82 have been assembled and positioned on downhole tool 88, the installation is accomplished by rotating actuation rod 96. FIG. 6 illustrates the first phase of the installation of sensor package 82. During the first phase of installation, actuation rod 96 is longitudinally fixed to upper housing 92 by the engagement of balls 104 and race 106. Therefore, as actuation rod 96 is rotated, threads 102 cause fin retainer 94, which is rotationally fixed to upper housing 92 by keyway 102, to move upward. The upward motion of fin retainer 94 moves contact fin 112 upward and along inclined ramp 110 until the fin engages the wall of flowbore 84.

When contact fin 112 contacts the wall of flowbore 84, the longitudinal or axial position of sensor package 82 is fixed. Because sensor package 82 is held at a known distance from pin end 86 during this phase, the longitudinal position of the sensor package can be closely controlled and easily replicated. Referring now to FIG. 7, once the position of sensor package 82 is fixed, installation tool 80 shifts into a second phase of the installation that allows an additional preload to be applied to the sensor package.

The engagement between contact fin 112 and the wall of flowbore 84 stops the longitudinal movements of the contact fin and prevents fin retainer 94 from moving longitudinally. Since fin retainer 94 is now constrained both longitudinally and rotationally, continued rotation of actuation rod 96 will cause the rod to move downward relative to upper housing 92. Balls 104 will resist this downward movement until the balls disengage from race 106 and engage ball thread 108. The disengagement of balls 104 from race 106 allows actuation rod 96 to move downward and apply a longitudinal force to sensor package 82. Rotation of actuation rod 96 can continue until a desired preload is achieved. The amount of preload applied to sensor package can be determined and controlled by the number of rotations of actuation rod 96 or level of torque applied to the actuation rod. Once the desired preload is achieved, installation tool 80 can then be removed, leaving sensor package 82 securely in place in downhole tool 88—fixed to resist both longitudinal and radial movement.

Figure 8:
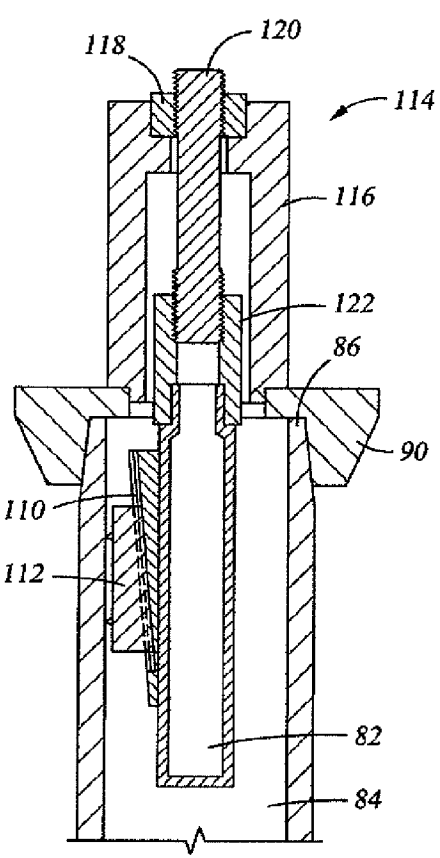
FIG. 8 is a sectional view of the sensor package of FIG. 6 being uninstalled from the tubular member.

Referring now to FIG. 8, sensor package 82 is removed from tubular member 88 using removal tool 116. Once pin end 86 of downhole tool 88 is retrieved from the well bore and brought to the surface, base member 90 is reinstalled onto the pin end. Removal tool 116 comprises housing 116, threaded nut 118, actuation rod 120, and threaded adapter 122. Threaded adapter 122 is installed onto the end of sensor package 82. Actuation rod 120 is coupled to threaded adapter 122 and passes through housing 118. The upper end of actuation rod 120 is coupled to threaded nut 118. Rotation of actuation rod 120 creates an upward force on sensor package 82. This upward force causes contact fin 112 to move down ramp 110, thus pulling the fin radially inward and away from the wall of flowbore 84.

While the disclosure is susceptible to implementation in various forms, specific embodiments thereof are shown by way of example in the drawings and description. It should be understood, however, that the drawings and detailed description thereto are not intended to limit the disclosure to the particular form disclosed, but on the contrary, the intention is to cover all modifications, equivalents and alternatives falling within the spirit and scope of the following claims.

What is claimed is:

1. An apparatus for use in a downhole tool, the apparatus comprising:

a body disposable within a flowbore of a downhole tool;

a sensor assembly disposed within said body; and an engagement mechanism coupled to said body, the engagement mechanism comprising:

a plurality of inclined ramps disposed in spaced-apart relationship about the circumference of said body and unconnected to one another; and a plurality of contact fins, each of said contact fins slidably coupled to one of said inclined ramps by engagement with a slot disposed between the ramp and the fin;

a plurality of flow channels spaced-apart about the circumference of said body, disposed between said inclined ramps, and configured to allow fluid movement through the flowbore and past the body;

wherein the engagement mechanism has a first position that allows said body to move longitudinally through the flowbore and a second position that prevents movement of said body relative to the flowbore.

2. The apparatus of claim 1, wherein the flow channels extend radially from the body of the apparatus to the flowbore of the downhole tool.

3. The apparatus of claim 1, wherein said contact fin comprises a contact surface configured to engage a wall of the flowbore when said engagement mechanism is in the second position.

4. The apparatus of claim 1, further comprising:

a locking wedge moveably coupled to each of said inclined ramps and operable to limit movement of said contact fin relative to said inclined ramp.

5. The apparatus of claim 1, wherein said sensor assembly further comprises:

a sensor configured to collect data; and a memory module operably coupled to said sensor and configured to store data collected by said sensor.

6. The apparatus of claim 1, wherein said body is substantially aligned with a central axis of the flowbore when said engagement mechanism is in the second position.

7. The apparatus of claim 1, wherein the downhole tool is a drill bit.

8. A sensor package for use in a downhole tool, the sensor package comprising:

a body configured to be disposed within a flowbore of a downhole tool;

a sensor assembly disposed within said body;

a plurality of inclined ramps spaced-apart circumferentially about the body and unconnected to one another, each ramp having a slot;

a plurality of contact fins spaced-apart circumferentially about said body; wherein each of said contact fins is slidably coupled to one of said inclined ramps by engagement with said slot; and a plurality of axially-extending flow channels disposed between the inclined ramps and configured to allow fluid movement through the flowbore;

wherein said contact fins have a first position that allows movement of said body relative to the flowbore and a second position that prevents movement of said body relative to the flowbore.

9. The sensor package of claim 8, wherein each of said contact fins comprises a contact surface configured to engage a wall of the flowbore when said contact fin is in the second position.

10. The sensor package of claim 8, further comprising:

a locking wedge moveably coupled to one of said inclined ramps and operable to limit movement of one of said contact fins relative to one of said inclined ramps.

11. The sensor package of claim 8, wherein said sensor assembly further comprises:

a sensor configured to collect data; and a memory module operably coupled to said sensor and configured to store data collected by said sensor.

12. The sensor package of 8, wherein the downhole tool is a drill bit.

13. The sensor package of claim 8, wherein said body is substantially aligned with a central axis of the flowbore when said contact fins are in the second position.

14. A method for installing a sensor package in a downhole tool, the method comprising:

assembling a sensor package by:

disposing a sensor assembly in a housing;

disposing on the housing a plurality of inclined ramps in spaced-apart relationship about the circumference of the housing and unconnected to one another;

slidably engaging a contact fin with a slot adjoining each of the inclined ramps;

disposing the sensor package within a flowbore of a downhole tool;

moving the contact fin relative to the inclined ramp until the contact fin engages a wall of the flowbore; and providing a plurality of axially-extending flow channels disposed between the inclined ramps and configured to allow fluid movement through the flowbore.

15. The method of claim 14, wherein the body is held substantially stationary relative to the flowbore as the contact fin is moved along the inclined ramp.

16. The method of claim 14, further comprising:

applying a longitudinal force to the sensor package after the contact fin is engaged with the wall of the flowbore.

17. The method of claim 14, further comprising:

moving a locking wedge relative to the inclined ramp into a position that limits the movement of the contact fin relative to the inclined ramp.

18. The method of claim 14, wherein the sensor package is substantially aligned with a central axis of the flowbore when the contact fin is engaged with the wall of the flowbore.

19. The method of claim 14 wherein the downhole tool is a drill bit.

* * * * *